US010322428B2

(12) United States Patent
Van Houten et al.

(10) Patent No.: US 10,322,428 B2
(45) Date of Patent: Jun. 18, 2019

(54) TRIGGER SPRAY VALVE BODY WITH PASS THROUGH FILLING PATH

(71) Applicant: Silgan Dispensing Systems Corporation, Grandview, MO (US)

(72) Inventors: Brian Van Houten, Kansas City, MO (US); Joseph Krestine, Louisburg, KS (US); Leah Flynn, Shawnee, KS (US); Alejandro Espinoza, Overland Park, KS (US)

(73) Assignee: Silgan Dispensing Systems Corporation, Grandview, MO (US)

( * ) Notice: Subject to any disclaimer, the term of this patent is extended or adjusted under 35 U.S.C. 154(b) by 0 days.

(21) Appl. No.: 15/681,662

(22) Filed: Aug. 21, 2017

(65) Prior Publication Data

US 2019/0054487 A1 Feb. 21, 2019

(51) Int. Cl.
*B05B 11/00* (2006.01)

(52) U.S. Cl.
CPC ..... *B05B 11/3011* (2013.01); *B05B 11/3045* (2013.01); *B05B 11/3074* (2013.01)

(58) Field of Classification Search
CPC ..... B05B 11/3011; B05B 11/3045; B05B 11/3074
USPC ..... 222/165, 318, 383.1, 402.16
See application file for complete search history.

(56) References Cited

U.S. PATENT DOCUMENTS 5,385,302 A * 1/1995 Foster ..... B05B 1/3431 239/333
5,570,840 A * 11/1996 Gettinger ..... B05B 7/0433 239/112
6,345,738 B1 * 2/2002 Brozell ..... B05B 11/3009 141/18
7,175,056 B2 * 2/2007 Buti ..... B05B 11/3011 222/340
8,714,415 B2 * 5/2014 Rech ..... B05B 11/0059 222/376
2002/0020720 A1 * 2/2002 Schmid ..... B05B 11/0037 222/383.1
2006/0196885 A1 * 9/2006 Leach ..... A61M 1/02 222/82
2010/0096414 A1 * 4/2010 Dennis ..... B05B 11/0005 222/383.1
2012/0261438 A1 * 10/2012 Dejong ..... B05B 11/3011 222/383.1
2014/0346193 A1 * 11/2014 Conway ..... B05B 11/3011 222/173

* cited by examiner

*Primary Examiner* — Vishal Pancholi
(74) *Attorney, Agent, or Firm* — Barlow Josephs and Holmes LTD

(57) ABSTRACT

A sprayer device with a trigger operated pump is operative for pumping and spraying liquid from an attached liquid container. The sprayer device includes an integrally molded valve body provided with a base portion that is configured to be mounted to the neck of the liquid container and a delivery nozzle from which the liquid is sprayed. A pumping chamber in the valve body is in fluid communication with an inside of the fluid container and is further in fluid communication with the delivery nozzle. The valve body is further provided with a head portion that has a filling passage extending between the head portion and the base portion such that a liquid received in the head portion flows through the valve body, around the pumping chamber and exits the base portion into the mounted liquid container.

12 Claims, 8 Drawing Sheets

TRIGGER SPRAY VALVE BODY WITH PASS THROUGH FILLING PATH

BACKGROUND OF THE INVENTION

(1) Field of the Invention

The instant invention relates to sprayer devices and more particularly to a liquid pump sprayer manually operated by means of a trigger lever.

(2) Description of Related Art

A sprayer of the type generally contemplated herein comprises a valve body provided with a base configured to be mounted to neck of a liquid container, a delivery nozzle from which the liquid is sprayed, a spring biased trigger lever that is operated manually by the user and a pump operated by the trigger lever to suction liquid from the container and to spray it through the nozzle. The pump has a piston acting in a chamber formed in the valve body. The valve body further comprises an inlet duct with a connecting dip tube that extends from the pump chamber to the inside of the liquid container and an outlet duct extending from the pump chamber to the sprayer nozzle. Within the pump chamber there is a suction and delivery valve adapted to allow the liquid to be sucked in a one-way direction from the container up through the dip tube to the pump chamber and to deliver the liquid from the pump chamber to the delivery nozzle. While reference is made to sprayers for liquids, it should be understood that the presently described types of spray devices can also be used to spray any type of fluid, such as foams or the like.

While the existing pump sprayer are effective for their intended purposes, an ever-evolving consumer market requires novel and improved designs which provide for added functionality, a reduced number of parts and reduced connection and leak points.

SUMMARY OF THE INVENTION

An exemplary embodiment comprises a sprayer device with a trigger operated pump that is operative for pumping and spraying liquid from an attached liquid container.

The sprayer device includes an integrally molded valve body provided with a base portion that is configured to be mounted to a neck of a liquid container. The exemplary base portion may be snap fit or plug fit onto the neck of the container or may include a bayonet type connection, or threaded connection or any other connection as known in the art.

The valve body is provided with a delivery nozzle from which liquid from the container is sprayed and has a pumping chamber which is in fluid communication with an inside of the fluid container through an inlet duct and a dip tube, and is further in fluid communication with the delivery nozzle through an outlet duct.

The valve body is further provided with a head portion that is configured to receive a filling container and has a filling passage extending between the head portion and the base portion such that a liquid received in the head portion flows through the valve body, around the pumping chamber and exits the base portion into the neck of the mounted liquid container. The filling container may be snap fit or plug fit onto the head portion of the valve body or may include a bayonet type connection, or threaded connection or any other connection as known in the art. In one exemplary embodiment, the filling container may be sealed and pierced as it is applied to the valve body, or may include a valve to release the contents. In another exemplary embodiment, the valve body may include a separate flow valve to selectively allow flow through the filling passage. In yet another exemplary embodiment, the head portion may receive a shroud or cover with a door or hatch which can be selectively opened to expose the filling path whereby the user can fill the container through the door or hatch.

A trigger lever is hinged to the valve body and to a stem of a plunger or piston which is slidable in the pumping chamber to suction and pump liquid from the liquid container. A spring is captured between the trigger lever and the valve body to bias the trigger outwardly. A suction and delivery valve located within the pumping chamber cooperates with the inlet duct and the outlet duct to control suction of the liquid from the container and delivery of the liquid to the delivery nozzle.

It can thus be appreciated that the exemplary embodiment provides a unique valve body and sprayer which simplifies and reduces the number of parts while also reducing the number of potential leak points to the connections between the valve body base and the liquid container and the valve body head and the filling container.

BRIEF DESCRIPTION OF THE DRAWINGS

While the specification concludes with claims particularly pointing out and distinctly claiming particular embodiments of the instant invention, various embodiments of the invention can be more readily understood and appreciated from the following descriptions of various embodiments of the invention when read in conjunction with the accompanying drawings in which:

DETAILED DESCRIPTION OF THE INVENTION

Figure 1:
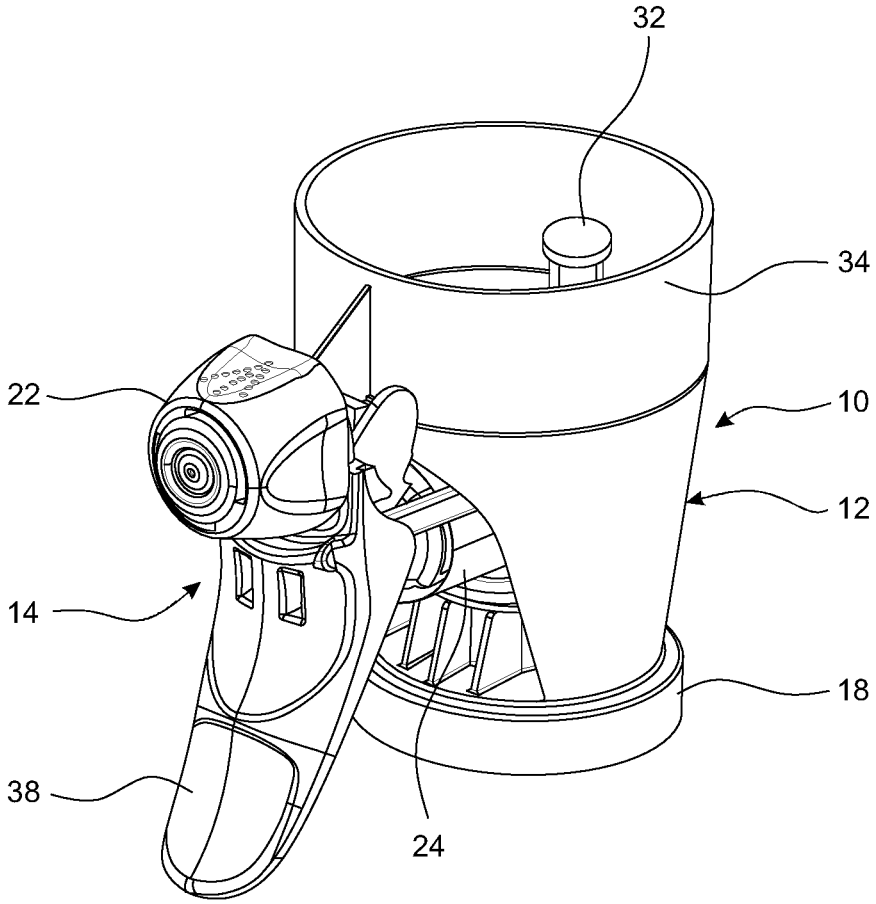
FIG. 1 is a perspective view of an exemplary embodiment of a trigger sprayer assembly having a pass through filling path.
Figure 2:
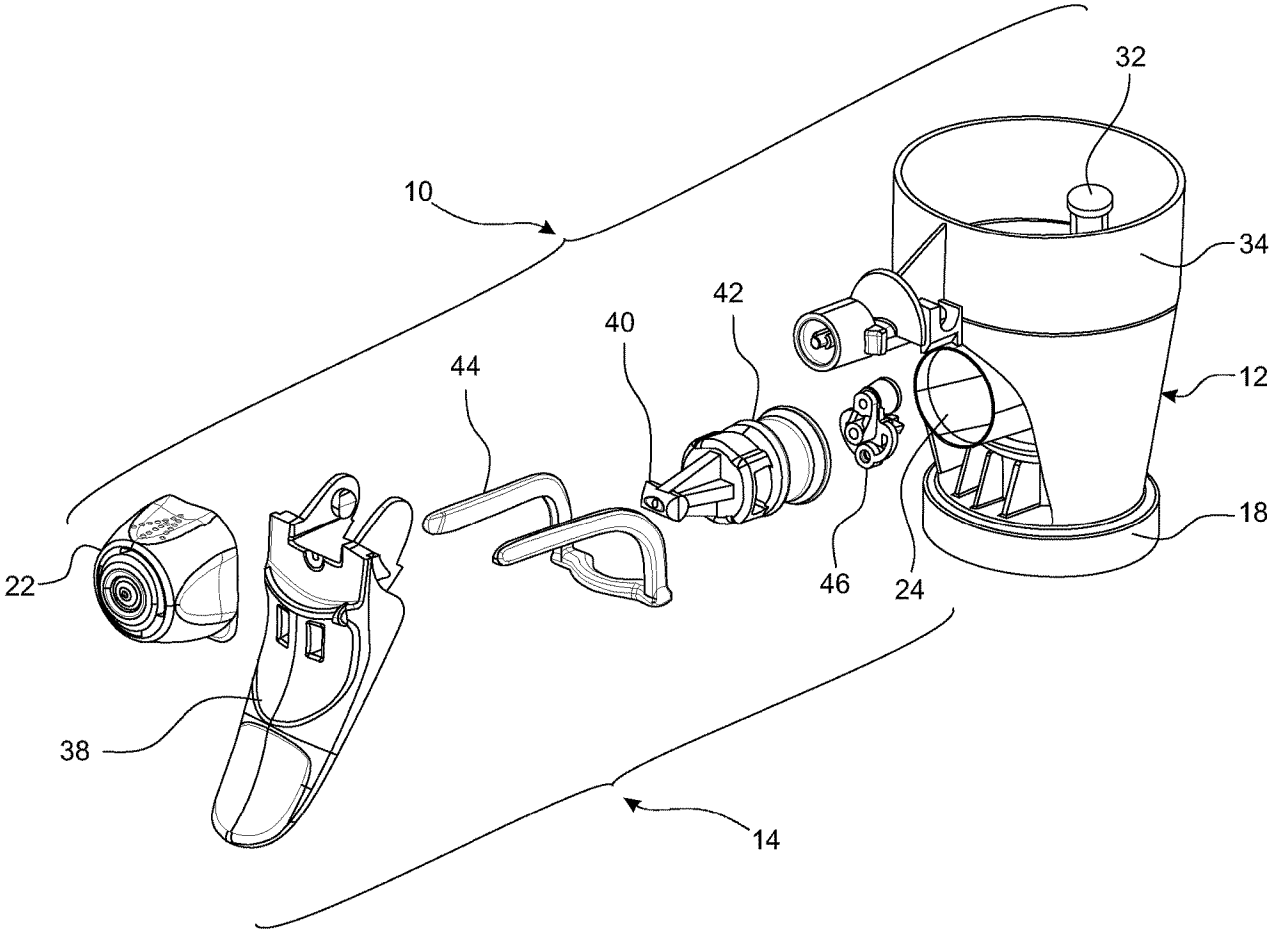
FIG. 2 is an exploded perspective view thereof.
Figure 3:
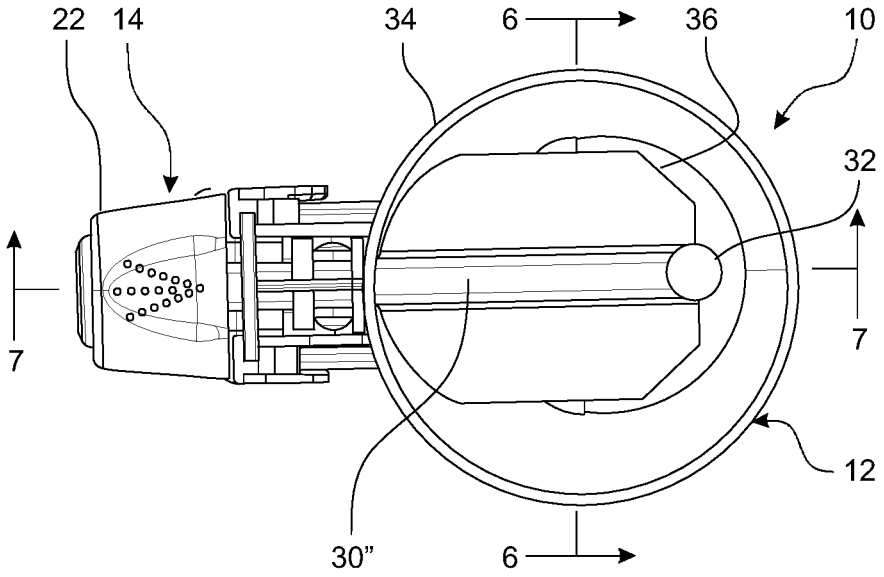
FIG. 3 is a top view thereof.
Figure 4:
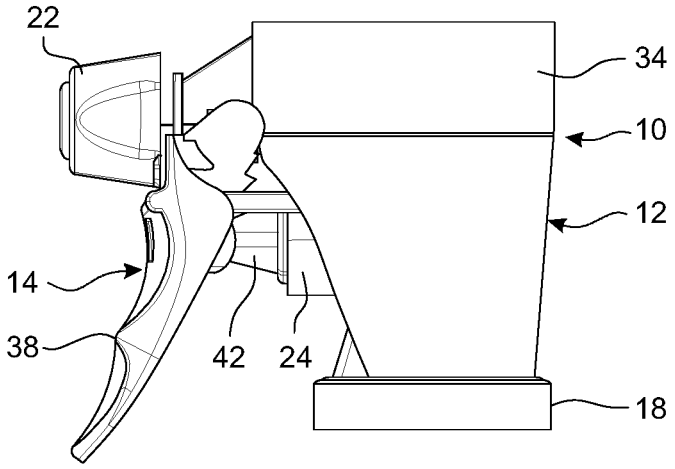
FIG. 4 is a side view thereof.
Figure 5:
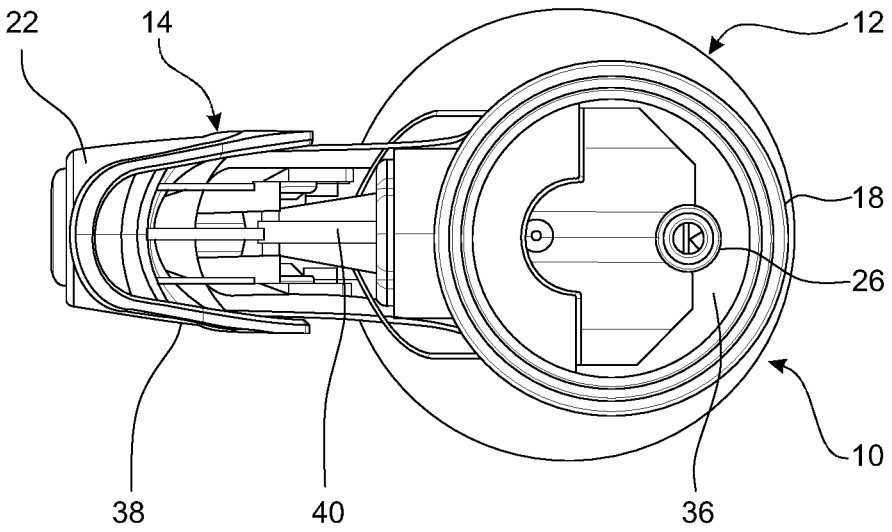
FIG. 5 is a bottom view thereof.
Figure 6:
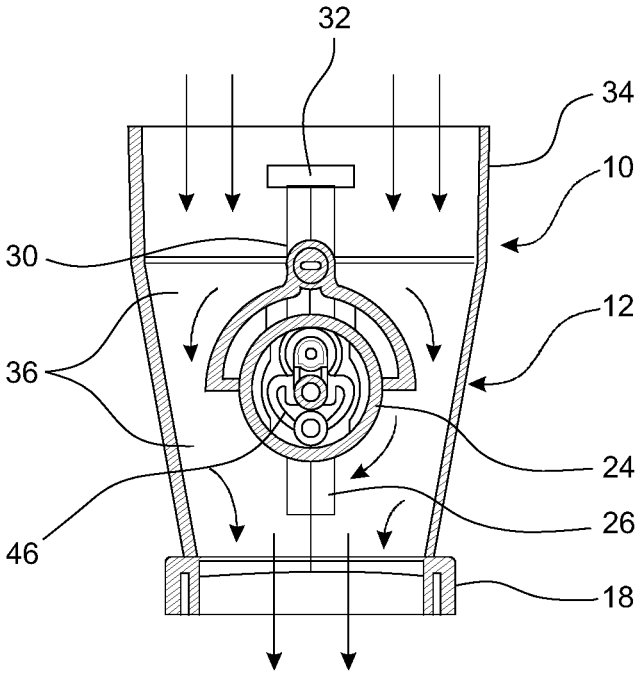
FIG. 6 is a cross-sectional view thereof taken along line 6-6 of FIG. 3.

Referring now to the drawings, an exemplary embodiment of a trigger sprayer device 10 incorporating an exemplary valve body 12 is illustrated in FIGS. 1-7. The exemplary valve body 12 is best illustrated in FIGS. 8-13.

Figure 7:
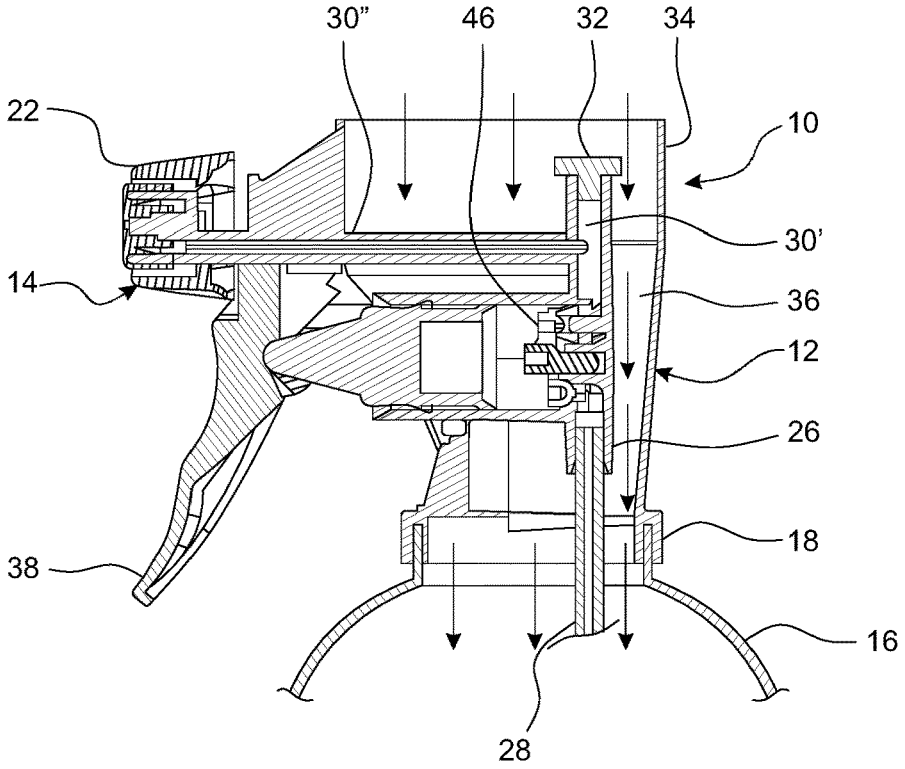
FIG. 7 is another cross-sectional view thereof taken along line 7-7 of FIG. 3.
Figure 8:
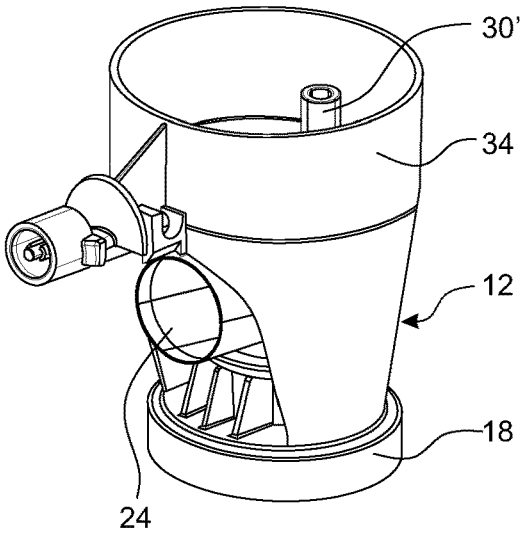
FIG. 8 is a perspective view of the exemplary trigger sprayer valve body.
Figure 9:
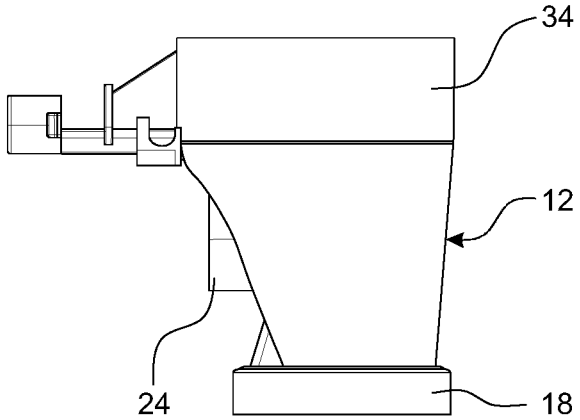
FIG. 9 is a side view thereof.
Figure 10:
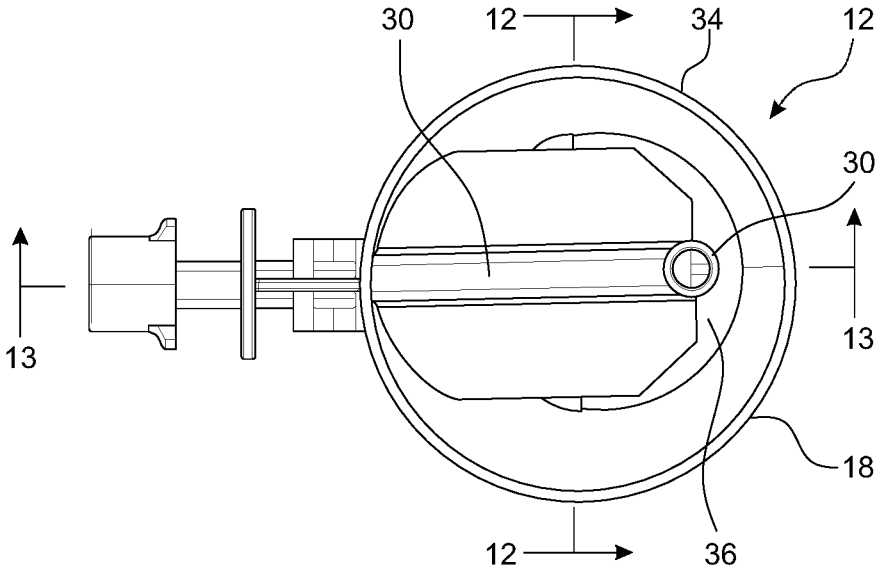
FIG. 10 is a top view thereof.
Figure 11:
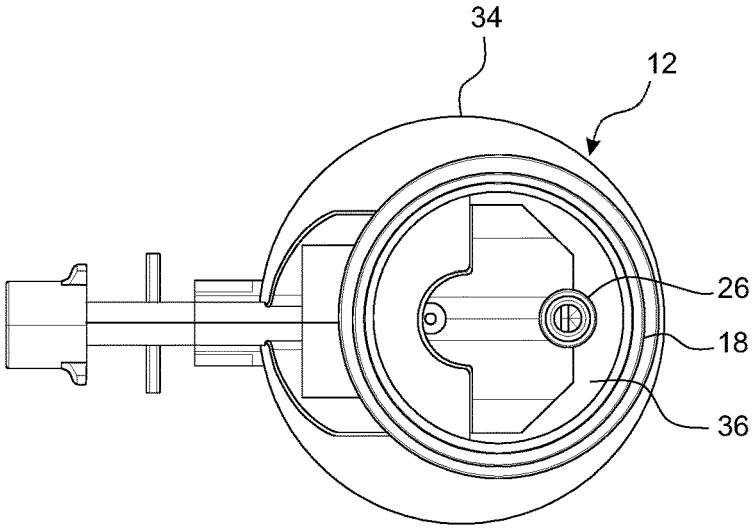
FIG. 11 is a bottom view thereof.
Figure 12:
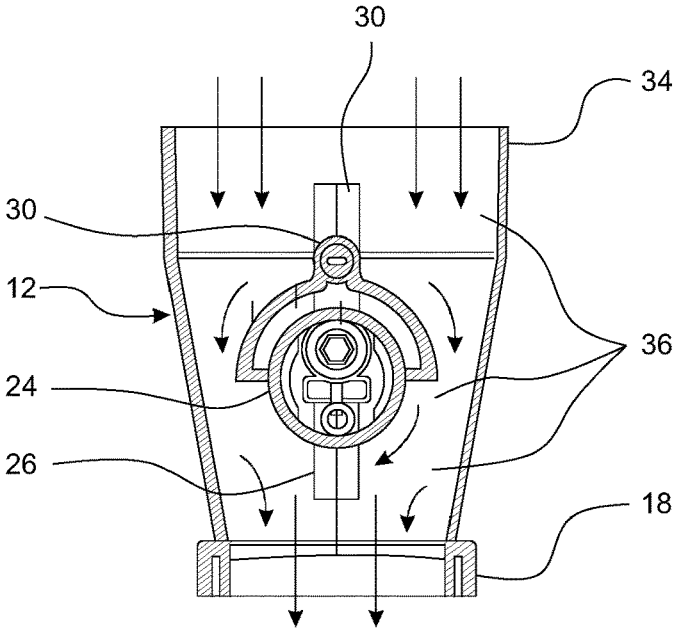
FIG. 12 is a cross-sectional view thereof taken along line 12-12 of FIG. 10.
Figure 13:
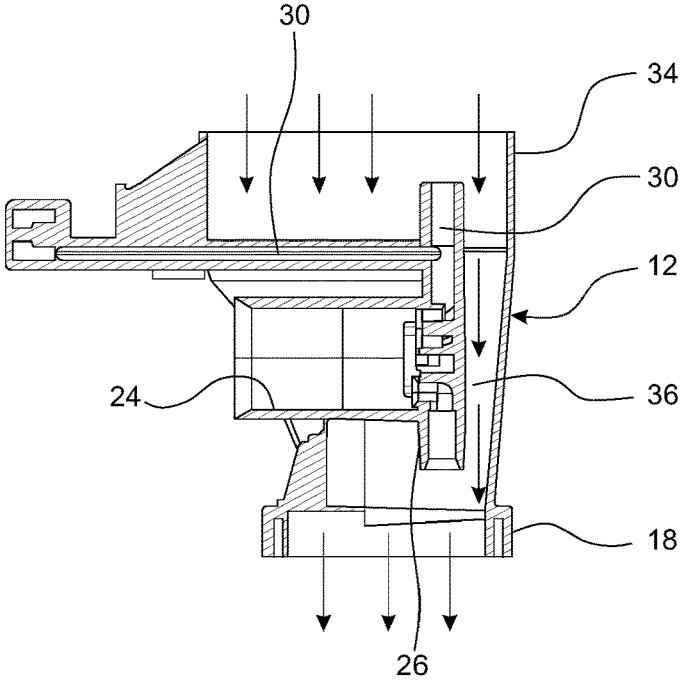
FIG. 13 is another cross-sectional view thereof taken along line 13-13 of FIG. 10.

The exemplary sprayer device 10 comprises a trigger operated pump assembly 14 (See FIG. 2) that is operative for pumping and spraying liquid from an attached liquid container 16 (See FIG. 7).

The sprayer device 10 includes an integrally molded valve body 12 provided with a base portion 18 that is configured to be mounted to a neck 20 of a liquid container 16. The exemplary base portion 18 may be snap fit or plug fit onto the neck 20 of the container 16 or may include a bayonet type connection, or threaded connection or any other connection as known in the art.

The valve body 12 is provided with a delivery nozzle 22 from which liquid from the container 16 is sprayed and has a pumping chamber 24 which is in fluid communication with an inside of the fluid container 16 through an inlet duct 26 and a dip tube 28 (FIG. 7) which extends down into the liquid container 16 in a conventional manner. The pumping chamber 24 is further in fluid communication with the delivery nozzle 22 through an outlet duct 30 having a vertical portion 30' and a horizontal extension 30" leading to the delivery nozzle 22. A plug body 32 is received into the top of the vertical portion 30' of the outlet duct 30 to force liquid into the horizontal extension 30" of the outlet duct 30.

The valve body 12 is further provided with a head portion 34 that is configured to receive a filling container (not shown) and has a flow-through filling passage 36 extending between the head portion 34 and the base portion 18 such that a liquid (see arrows FIGS. 6-7) received in the head portion 34 flows through the valve body 12, around the pumping chamber 24 and exits the base portion 18 into the neck 20 of the mounted liquid container 16. The filling container may contain a pre-mixed liquid to be sprayed or contain a concentrate to be mixed with water in the container 16. The flow path 36 and liquid flow through the valve body 12 is best shown by the arrows in the cross-sectional views in FIGS. 6 and 7. The filling container may be snap fit or plug fit onto the head portion 34 of the valve body 12 or may include a bayonet type connection, or threaded connection or any other connection as known in the art. In one exemplary embodiment, the filling container may be sealed and pierced as it is applied to the valve body 12, or may include a valve to release the contents. In another exemplary embodiment, the valve body may include a separate flow valve (not shown) to selectively allow flow through the filling passage 36.

Figure 14:
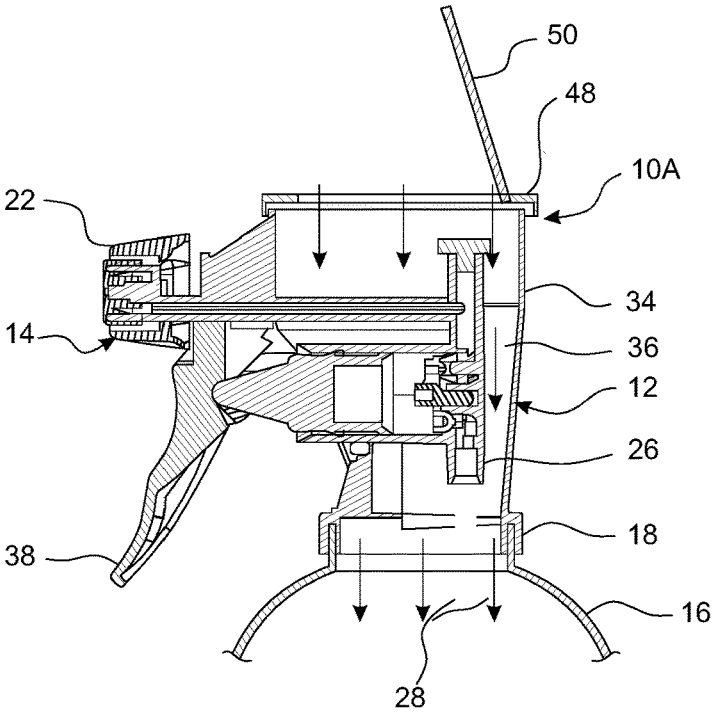
FIG. 14 is a cross-sectional view of another exemplary trigger sprayer assembly with a cover and filling hatch.

When the filling container is not present, the open head portion 34 allows the user to fill the liquid container 16 with water or other spray liquid directly through the top of the valve body 12 without removing the valve body 12. In this regard, another exemplary embodiment 10A is shown in FIG. 14 wherein assembly 10A includes a cover or shroud 48 with a hatch or door 50 that can be selectively opened and closed to allow the user to fill the container through the hatch or door 50. The cover can be part of a larger shroud, or can be a snap-fit or sealed cover with a sliding or hinged door. Other configurations are also contemplated.

A trigger lever 38 is hinged to the valve body 12 and to a stem 40 of a plunger or piston 42 which is slidable in the pumping chamber 24 to suction and pump liquid from the liquid container 16. A spring 44 is captured between the trigger lever 38 and the valve body 12 to bias the trigger 38 outwardly. A suction and delivery valve 46 located within the pumping chamber 24 cooperates with the inlet duct 26 and the outlet duct 30 to control suction of the liquid from the container 16 and delivery of the liquid to the delivery nozzle 22. Operation of the pump assembly 14 and of the suction and delivery valve 46 are better described in U.S. Pat. Nos. 7,175,056 and 8,714,415, the entire contents of which are incorporated herein by reference.

It can thus be appreciated that the exemplary embodiments provide a unique flow through or pass through valve filling body 12 and sprayer 10 which simplifies and reduces the number of parts while also reducing the number of potential leak points to the connections between the valve body base 18 and the liquid container 16, and the valve body head 34 and the filling container.

While there is shown and described herein certain specific structures embodying various embodiments of the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A sprayer device with a trigger operated pump operative for pumping and spraying liquid from a liquid container, said sprayer device comprising:

a valve body provided with a base portion that is configured to be mounted to a neck of a liquid container and a delivery nozzle from which liquid from the container is sprayed, said valve body further including a pumping chamber which is in fluid communication with an inside of said fluid container through an inlet duct and is further in fluid communication with said delivery nozzle through an outlet duct, said valve body further provided with a head portion disposed at least partially above said pumping chamber and said delivery nozzle and having an opening therein, said valve body further having a filling passage extending between said opening of said head portion and said base portion such that a liquid received in said head portion flows through the valve body and exits the base portion into the mounted liquid container;

a trigger lever hinged to the valve body and to a stem of a plunger slidable in said pumping chamber;

a spring captured between said trigger lever and said valve body; and a suction and delivery valve located within the pumping chamber and cooperating with the inlet duct and the outlet duct to control suction of the liquid from the container and delivery of the liquid to the delivery nozzle, wherein the opening of the head portion is disposed above the pumping chamber and the filling passage is disposed over the entire base portion.

2. The sprayer device of claim 1 wherein said filling passage extends around the top, sides and back of the pumping chamber.

3. The sprayer device of claim 1 wherein the base portion of the valve body is snap fit onto the neck of the liquid container.

4. The sprayer device of claim 1 wherein the valve body is integrally molded from a plastic material as a single piece, and said suction and delivery valve is elastomeric.

5. A sprayer device comprising:

a valve body provided with a base portion that is configured to be mounted to a neck of a liquid container and a delivery nozzle from which liquid is sprayed, said valve body further including a pumping chamber which is in fluid communication with an inside of said fluid container through an inlet duct and is further in fluid communication with said delivery nozzle through an outlet duct, said valve body further provided with a head portion having a filling passage extending between said head portion and said base portion such that a liquid received in said head portion flows through the valve body and exits the base portion;

a trigger lever hinged to the valve body and to a stem of a plunger in said pumping chamber;

a spring captured between said trigger lever and said valve body; and a suction and delivery valve located within the pumping chamber to control suction of the liquid from the container and delivery of the liquid to the delivery nozzle, wherein at least a portion of the head portion is disposed above the pumping chamber and above the dispensing nozzle and the filling passage is disposed over the entire base portion.

6. The sprayer device of claim 5 wherein said filling passage extends around the sides and back of the pumping chamber.

7. The sprayer device of claim 5 wherein the base portion of the valve body is snap fit onto the neck of the liquid container.

8. The sprayer device of claim 5 wherein the valve body is integrally molded from a plastic material as a single piece, and said suction and delivery valve is elastomeric.

9. A one piece, integrally molded valve body for a sprayer device comprising a base portion that is configured to be mounted to a neck of a liquid container and a delivery nozzle from which liquid from the container is sprayed, a pumping chamber which is in fluid communication with an inside of said fluid container through an inlet duct and is further in fluid communication with said delivery nozzle through an outlet duct, and a head portion disposed at least partially above said pumping chamber and said delivery nozzle and having an opening therein, said valve body further having a filling passage extending between said opening of said head portion and said base portion wherein a liquid received in said head portion flows through the valve body and exits the base portion, wherein the opening is disposed above the pumping chamber and the filling passage is disposed over the entire base portion.

10. The valve body of claim 9 wherein said filling passage extends around the sides and back of the pumping chamber.

11. The valve body of claim 9 wherein the base portion of the valve body is snap fit onto the neck of the liquid container.

12. The valve body of claim 9 wherein the valve body is integrally molded from a plastic material as a single piece.

* * * * *